US005584108A

United States Patent [19]

Pleyer

[11] Patent Number: 5,584,108

[45] Date of Patent: Dec. 17, 1996

[54] BUCKLE FOR SEAT BELT DEVICE

[75] Inventor: Matthias Pleyer, Ulm, Germany

[73] Assignee: Takata Corporation, Tokyo, Japan

[21] Appl. No.: 508,183

[22] Filed: Jul. 27, 1995

[30] Foreign Application Priority Data

Dec. 26, 1994 [JP] Japan ..... 6-337285

[51] Int. Cl.[6] ..... A44B 11/00

[52] U.S. Cl. ..... 24/641; 24/637; 24/649

[58] Field of Search ..... 24/641, 643, 649, 24/632, 633, 636, 637

[56] References Cited

U.S. PATENT DOCUMENTS

| | | | |
|---|---|---|---|
| 4,451,958 | 6/1984 | Robben et al. | 24/636 |
| 4,527,317 | 7/1985 | Straszewski et al. | 24/641 |
| 4,920,620 | 5/1990 | Yamamoto et al. | 24/641 |
| 5,163,207 | 11/1992 | Krautz et al. | 24/641 |

FOREIGN PATENT DOCUMENTS

| | | | |
|---|---|---|---|
| 0114332 | 8/1984 | European Pat. Off. | 24/641 |

*Primary Examiner*—Victor N. Sakran
*Attorney, Agent, or Firm*—Kanesaka & Takeuchi

[57] ABSTRACT

A buckle includes a base frame 10, a latch plate 30, a locking wing 40 and an ejector 20. The base frame 10 is formed with a tongue insertion path 12 through which a tongue plate 2 is inserted. The latch plate 30 is pivotally supported on an upper surface of the base frame 10, having a latch pawl 33 formed at a front end and an operational arm 32 formed at a rear end, which is applied with pivoting force by the end of the tongue plate 2 when the tongue plate 2 is inserted. The locking wing 40 is structured to maintain the locked state by biasing force of a locking spring 37 between the locking wing 40 and the latch plate 30 and by an engagement between the locking wing 40 and locking pawl 33. The locking wing 40 is also structured to release the engagement between the locking wing 40 and the locking pawl 33 by a movement of a press button 52. The ejector 20 is supported slidably in the tongue insertion path 12 and biased by an ejector spring 21. By the biasing force of the ejector spring 21, the tongue plate 2 is released.

4 Claims, 5 Drawing Sheets

BUCKLE FOR SEAT BELT DEVICE

BACKGROUND OF THE INVENTION

The present invention relates to a buckle used in a seat belt device, more particularly, to a buckle of a compact construction for engaging with a tongue of the seat belt device.

A seat belt device used in a vehicle or the like comprises a tongue and a buckle for engaging with the tongue to fit a webbing, withdrawn from a retractor, with the body of an occupant. The buckle is generally fixed to a floor of the vehicle through a mounting plate or stalk. Thereby, the webbing can securely be supported by the buckle through the tongue even when a large tensile force is applied in the webbing when the vehicle comes into collision.

To raise the rate of wearing seat belt, the seat belt device is designed so that the tongue can be easily engaged to the buckle. Generally, the buckle is located on a side of a seat to reach easily. Because, in the case of a front seat, the position where the buckle is disposed is limited to a space between a driver's seat and a passenger seat. The buckle is designed to be miniaturized.

In manufacturing a buckle, the decrease of the number of parts constituting the buckle allows a lower manufacturing cost for the buckle.

In consideration of such points, some buckles have been proposed and developed. In Published Unexamined Japanese Patent Application No. (58)1983-27504, a small-sized buckle is proposed. The engagement and release of the buckle can be securely performed with a small number of moving elements. (See FIG. 1).

In the buckle, an L-like shaped rocker 108 biased in the initial state by a compression spring 109 mounted in a case tilts by a predetermined angle. Thereby, a retaining element 107 moves along the configuration of an L-shaped cutout 126. Moving of the retaining element 107 causes a latch (engaging element) 105 to pivot for locking and releasing operation of a tongue by a latch pawl 106. An ejector 104 is pushed by the end of a tongue plate 102 inserted along a tongue insertion path 139. Thereby the ejector 104 slides in the direction of the arrow X. The rocker 108 is then applied with the tilting force by the latch ejector 104. With the tilting of the rocker 108 in the direction of the arrow Y, an upper arm 124 of the rocker 108 moves the retaining element 107 downward along a front edge of the L-shaped cutout 126. The retaining element 107 pushes an upper surface of the latch 105 near the latch pawl 106 to pivot the latch 105. Thereby the latch 105 is inserted and engaged to an opening 103 of the tongue plate 102.

As described above, a series of locking and releasing operations comprise movements relating to a plurality of moving elements. Therefore, this requires precise manufacturing of the moving elements. In addition, this requires precise manufacturing of a base plate where each member is assembled. Furthermore, this increases the manufacturing cost of each member.

SUMMARY OF THE INVENTION

It is therefore an object of the present invention to provide a buckle for a seat belt device having high reliability that can solve the problems of the prior art as mentioned above and comprises a small number of members and each moving element of which has a simple structure.

In order to overcome the above mentioned object, the present invention provides a buckle comprising a base frame formed with a tongue insertion path through which a tongue plate is inserted; a latch plate which is pivotally supported on an upper surface of the base frame, has a latch pawl formed at a front end position thereof which is able to engage with an opening of the tongue plate inserted into the tongue insertion path, and has an operational arm formed at a rear end position thereof which is applied with pivoting force by the end of the tongue plate when the tongue plate is inserted; a locking wing structured to maintain the locked state of the latch plate by biasing force of a locking spring set between the locking wing and the latch plate and by an engagement between the locking wing and locking pawl formed on an upper surface of the base frame, the locking wing also being structured to release the engagement between the locking wing and the locking pawl by a contact portion formed on a press button corresponding to a movement of the press button and an ejector supported slidably in the tongue insertion path and biased by an ejector spring, the ejector being structured to, corresponding to the insertion of the tongue plate, come in contact with the end of the tongue plate, to slide, and to push the operational arm to pivot the latch plate to engage the latch pawl to the opening of the tongue plate, the ejector also being structured to protrude the tongue plate outside the buckle by the biasing force of the ejector spring when the engagement between the latch pawl and the opening of the tongue plate is released.

In the structure described above, the locking wing comprises a plate formed with two engaging holes. Preferably, when the tongue plate is inserted, the locking wing keeps in contact with the latch plate to move downward corresponding to the pivoting of the latch plate and maintains the locked state of the latch plate by engaging the engaging holes to the ends of two locking pawls at a position where the position of the engaging holes corresponds to the position of the ends of the locking pawls.

In addition, both sides of the tongue insertion path are preferably defined by tongue guiding portions formed by bending both sides of the base frame in a U-like shape to face each other.

When the tongue plate is engaged in the buckle, the locking wing can maintain more securely the engaged state of the latch pawl of the latch plate.

In the structure described above, the locking wing comprises a plate formed with two engaging holes. When the tongue plate is inserted, the locking wing keeps in contact with the latch plate to move downward corresponding to the pivoting of the latch plate and maintains the locked state of the latch plate by engaging the engaging holes to the ends of two locking pawls at a position where the position of the engaging holes corresponds to the position of the ends of the locking pawls, so that the locking of the latch plate is accomplished without delay corresponding the insertion of the tongue.

Furthermore, by defining both sides of the tongue insertion path by tongue guiding portions formed by bending both sides of the base frame in a U-like shape to face each other, the insertion and release movements of the tongue plate can be smoothly performed, thereby further improving the reliability of the buckle.

DETAILED DESCRIPTION OF THE PREFERRED EMBODIMENT

Referring to the attached drawings, an embodiment of a buckle according to the present invention will be described below.

Figure 1:
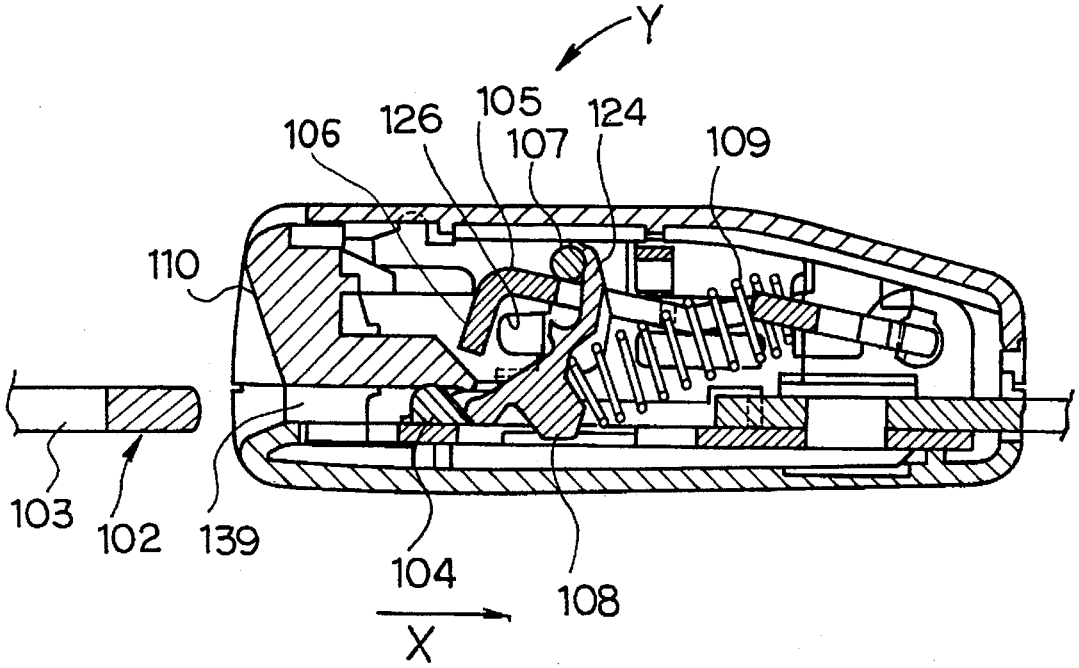
Fig. 1 PRIOR ART
FIG. 1 is a sectional view showing an example of a structure of a conventional buckle as a prior art.
Figure 2:
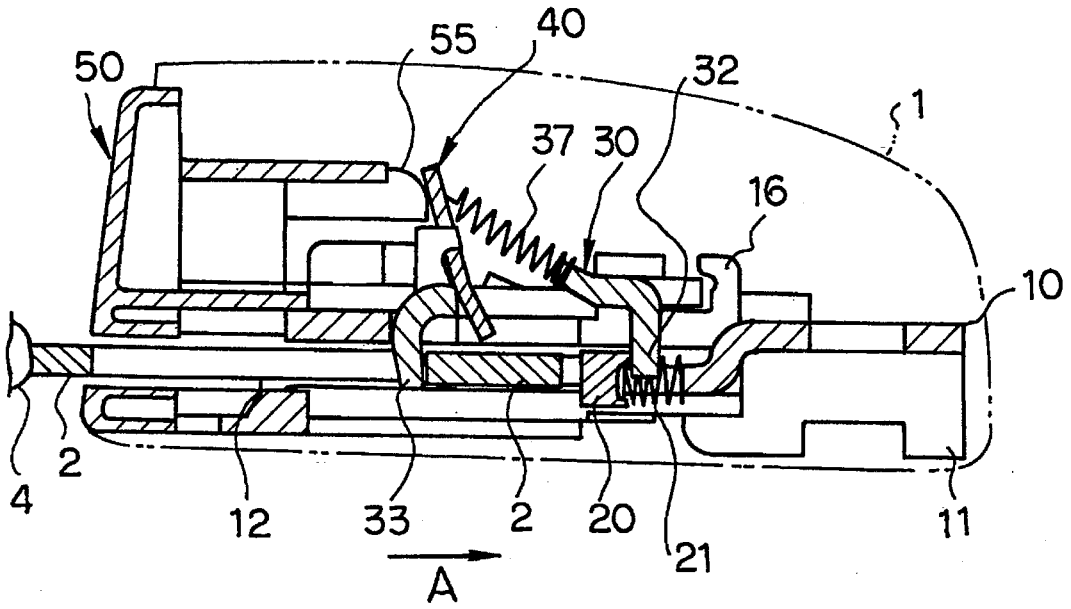
FIG. 2 is a sectional view showing an embodiment of a buckle according to the present invention.
Figure 3:
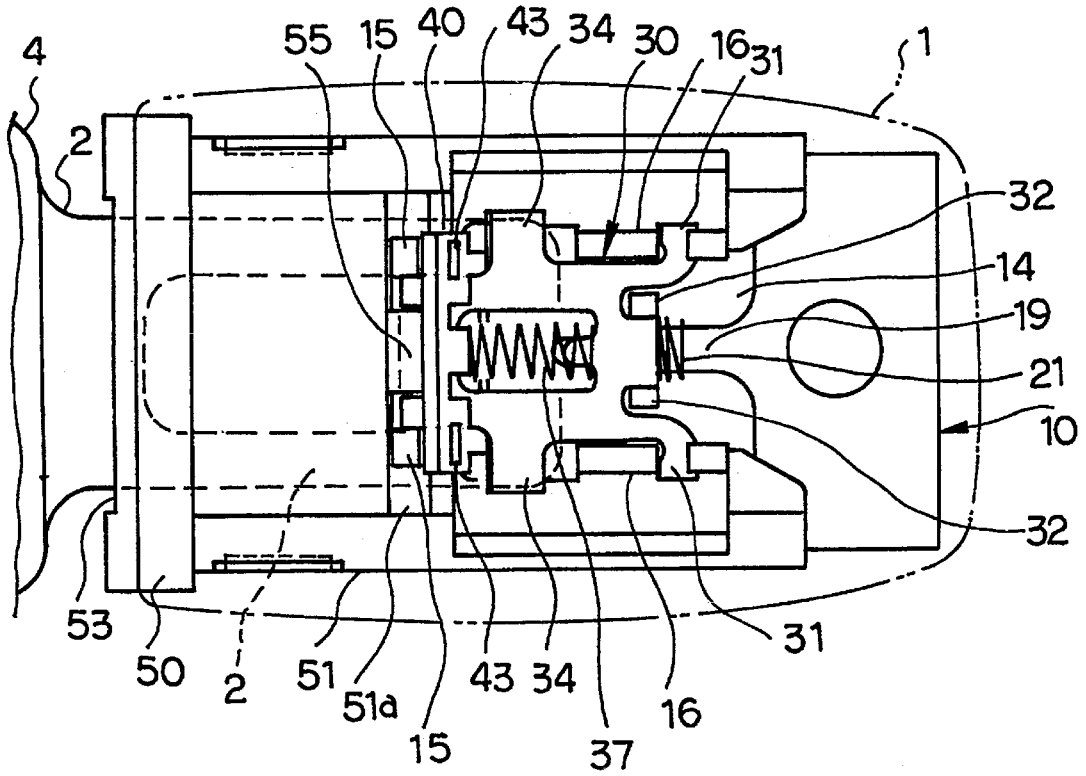
FIG. 3 is a plan view showing the embodiment of the buckle according to the present invention.
Figure 4:
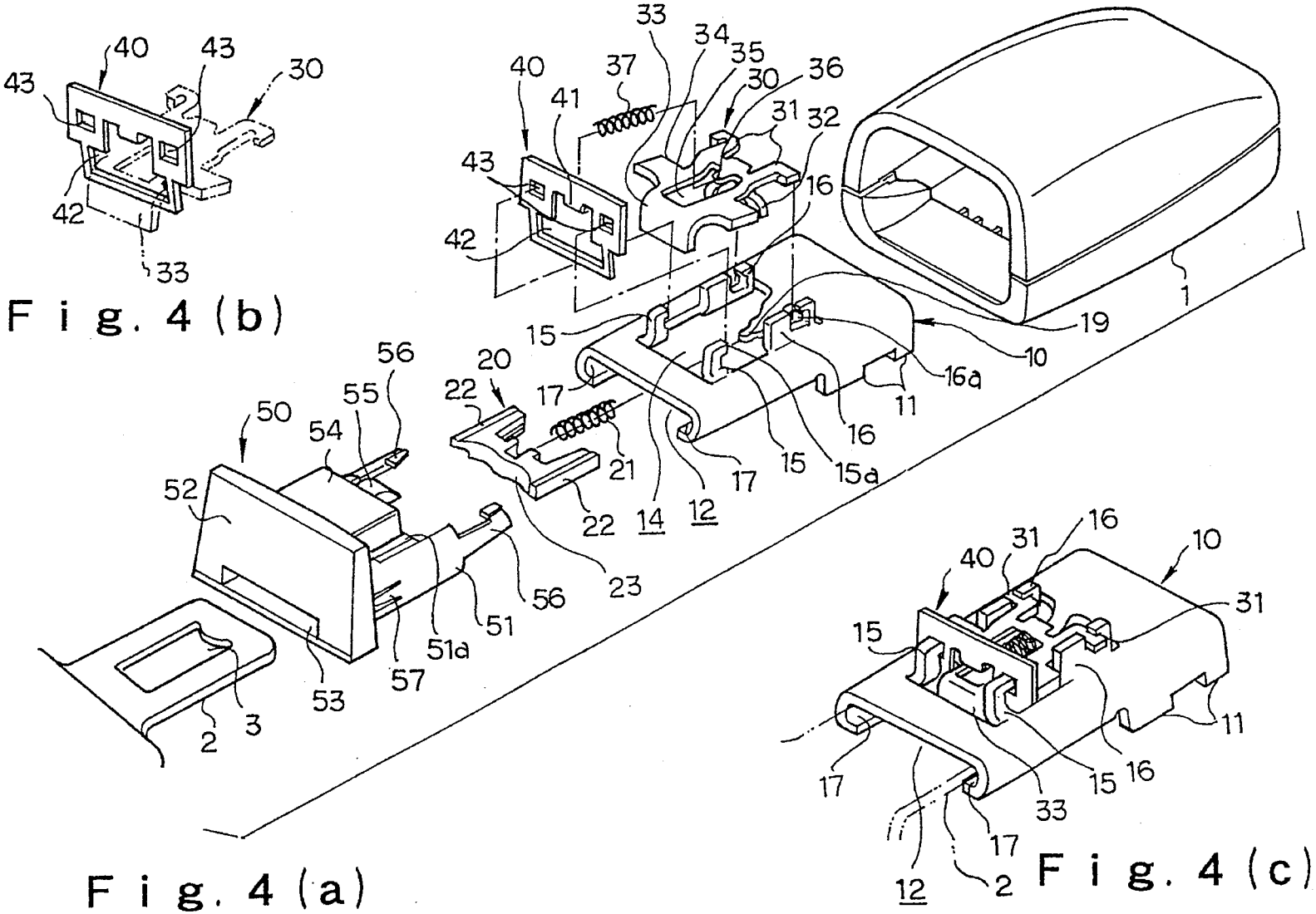
FIG. 4 (*a*) is an exploded perspective view showing the buckle as shown in FIG. 2, FIG. 4 (*b*) and FIG. 4 (*c*) are partly views of FIG. 4 (*a*), which show the assembled state.

FIGS. 2 and 3 are a sectional view and a plan view each showing the positional relation in the components of the buckle according to the present invention when a tongue plate is engaged. FIGS. 4 (*a*)–4 (*c*) are exploded perspective views for explaining the configurations of the components of the buckle.

In FIGS. 2 and 3, the numeral 10 designates a base frame. The base frame 10 is a product that is formed by bending after punching a steel plate in a predetermined configuration. The base frame 10 is provided with legs 11 formed at the rear end thereof by bending. The legs 11 are positioning members for positioning the base frame 10 when components assembled in the base frame 10 are accommodated in a buckle casing 1 (see FIG. 4).

On the other hand, a tongue insertion path 12 through which an ejector 20 and a tongue plate 2 are guided is formed on the front portion of the base frame 10. Both side portions of the tongue insertion path 12 are defined by tongue guiding portions 17 formed by bending both side portions of the base frame 10 downward in a U-like shape as shown in FIG. 4 (*a*).

Further, the base frame 10 is provided with a punched opening 14 formed in a predetermined configuration in the middle of the base frame 10. The base frame 10 is also provided with two locking pawls 15 and two bearing pawls 18. They are formed by bending residual portions of the base frame 10 substantially vertically to stand up to the upward direction in this figure. The locking pawls 15 and the bearing pawls 16 are placed symmetrically about the center line extending in the longitudinal direction of the base frame 10.

Furthermore, The ejector 20 biased by an ejector spring 21, i.e., a compression spring, to be kept in an initial position is supported in the tongue insertion path 12. The ejector 20 is angled U shape in plan (see FIG. 4 (*a*)). The ejector 20 has guide portions 22 formed on both sides thereof. The ejector 20 is guided with the guide portions 22 in angled U shape tongue guiding portions 17 of the base frame 10 to slide along the tongue insertion path 12.

As the tongue plate 2 is introduced into the tongue insertion path 12, the end of the tongue plate 2 pushes a tongue contact surface 23 of the ejector 20 to slide the ejector 20 rearward (in the direction of the arrow A in FIG. 2) against the biasing force of the ejector spring 21.

By bending the locking pawls 15 and the bearing pawls 16, the opening 14 is substantially formed in a rectangular shape. A latch plate 30 and a locking wing 40 are disposed in the opening 14 and the latch plate 30 is supported pivotally by the bearing pawls 16.

The locking pawls 15 formed on the front end of the opening 14 are projections each having an upper claw **15*a* that is formed in an inverted L-shape to face rearward. The upper claws 15*a* engage the engaging holes 43 of the locking wing 40, respectively, thereby keeping the engagement of the tongue plate 2**.

The bearing pawls 16 are formed with bearing cutouts **16*a* formed substantially in a rectangular shape, respectively. The ends of wing-like shafts 31 formed at both sides of the rear end of the latch plate 30 are freely supported in the bearing cutouts 16*a* to allow the shafts to pivot in a range of predetermined angle. The base frame 10 has an ejector spring holding pawl 19 formed on the central line thereof on the rear end of the opening 14 to hold an end of the ejector spring 21**.

Figure 5:
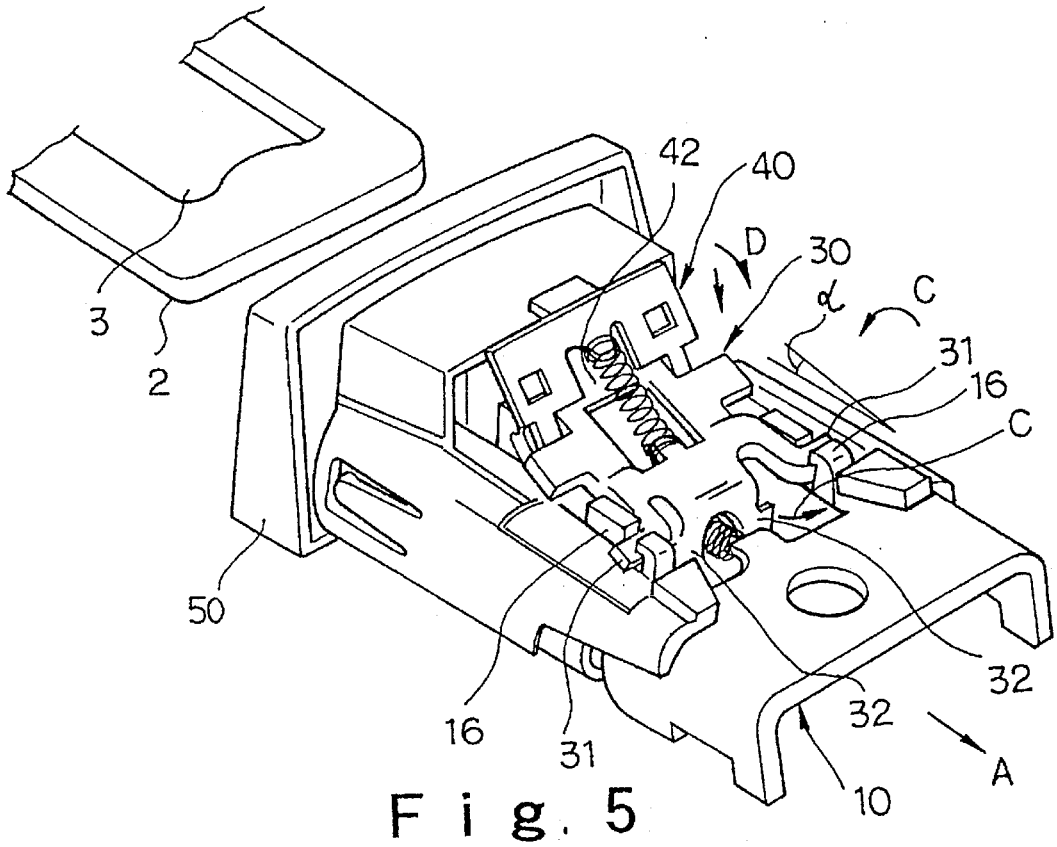
FIG. 5 is a perspective view of the buckle as shown in FIG. 2, which shows the positional relation in the components when a tongue is not engaged.

The description will now be made as regard to the configurations and operations of the latch plate 30 and the locking wing 40. The latch plate 30 has the wing-like shafts 31 at both sides of the rear end thereof as shown in FIG. 3 and FIG. 4 (*a*). The latch plate 30 has also operational arms 32 formed in an inverted U shape by bending downward the rear central portions to stride over the ejector spring holding pawl 19 and the ejector spring 21. As shown in FIG. 5, the operational arms 32 meet the ejector (not shown in FIG. 5) sliding in the direction of the arrow A through the tongue insertion path 12 formed in the base frame 10, thereby pivoting the latch plate SO about the wing-like shafts 31 in the direction of the arrow C corresponding to the movement of the ejector 20 in the direction of the arrow A.

On the other hand, the latch plate 30 has a wide latch pawl 33 formed at the end thereof, which is bent downward substantially by an angle of 90°. The latch plate 30 is also provided with wings 34 at both sides thereof. The wings 34 may meet portions **51*a* of side walls of the press button 50, thereby performing a release movement for releasing an engagement between the latch pawl 33 and an opening 3 of the tongue plate 2**.

The latch plate 30 is provided with a punched opening 35 and a spring holding pawl 36 for holding an end of a locking spring 37, which is formed on the rear end of the punched opening 35. The other end of the locking spring 37 is held to a holding pawl 41 positioned on the upper end of an opening of the locking wing 40. Therefore, the latch plate 30 and the locking wing 40 are positioned in the initial state so that there is a predetermined angle between them by the biasing force of the locking spring 37.

The locking wing 40 is a product that is punched from a thin steel sheet as shown in FIG. 4 (*a*). The locking wing 40 has an opening 42 formed in an inverted T shape in the middle thereof and the engaging holes 43 formed in a rectangular shape on both side portions thereof, respectively. The locking wing 40 is assembled with the latch plate 30 by, with the locking spring 37 being set up in the compressed state, inserting the latch plate 30 into the opening 42 as shown in FIG. 4 (b) to positioning the end of the latch pawl 33 over the opening 42. The locking wing 40 and the latch plate 30 in this state are assembled in the opening 14 of the base frame 10 by supporting the wing-like shafts 31 of the latch plate 30 by the bearing pawls 16 as shown in FIG. 4 (*c*).

FIG. 4 (*c*) shows a state in which the tongue plate 2 is inserted into the tongue insertion path 12 of the base frame 10 and the upper claws 15*a* of the locking pawls 15 engage the engaging holes 43 of the locking wing 40, respectively.

The press button 50 made of resin is provided with side walls 51 at both sides thereof. The press button 50 is slidably fitted in the base frame 10 at the front end position thereof to cover the U-shaped tongue guiding portions 17 constituting the tongue insertion path 12. This press button 50 is a manual button for releasing the tongue. A press portion 52 disposed in the front of the press button 50 has a tongue insert opening 53 formed in the lower portion thereof, into which the tongue plate 2 is inserted. A lock release block 54 substantially formed in a rectangular shape is integrally formed at the back side of the press portion 52. By pressing the press button 50 to release the tongue, a contact portion 55 disposed at the center of the lock release block 54 pushes the upper center portion of the locking wing 40 corresponding to the sliding of the press button 50.

The both side walls 51 are provided with hook-like springs 57 and legs 56 by cutting out portions of the side walls 51. By the hook-like springs 57 and the legs 56, the press button 50 can slide smoothly without scuffing with the base frame 10.

The description will now be made as regard to the moving positions of the components of the buckle as structured above, about FIG. 5 and FIG. 6. FIG. 5 is a schematic perspective view showing the initial state before the insertion of the tongue plate 2. For making the explanation easier, the figure shows the state without the buckle casing 1. As shown in this figure, the latch plate 30 is pivotally mounted in the base frame 10 by supporting the wing-like shafts 31 by the bearing pawls 16. In addition, the latch pawl 33 formed at the end of the latch plate 30 is inserted into the opening 42 of the locking wing 40. The locking spring 37 is set in the compressed state between the latch plate 30 and the locking wing 40. Thereby, the locking wing 40 is pushed against the contact portion 55 of the press button 50 by the biasing force of the locking spring 37. The latch plate 30 is maintained in the initial state in which the latch plate 30 is angled to the base frame 10 by an angle α. In this state, as the tongue plate 2 is inserted through the tongue insert opening 53 of the press button 50, the tongue plate 2 pushes the ejector 20 by the end thereof in the direction of the arrow A against the biasing force of the ejector spring 21 through the tongue insertion path 12 of the base frame 10. The back of the ejector 20 meets the operational arms 32 of the latch plate 30 so that the operational arms 32 slightly tilt in the direction of the arrow C upon the insertion of the tongue plate 2. At the same time, the latch plate 30 as a whole also pivots in the direction of the arrow C in the state supported with the wing-like shafts 31 to the bearing pawls 16. At the same time again, the locking wing 40 slightly rotates in the direction of the arrow D against the biasing force of the locking spring 37 and slides downward corresponding to the pivoting of the latch plate 30 in the direction of the arrow C. Thereby, the locking wing 40 becomes in the standing state as shown in FIG. 6.

Figure 6:
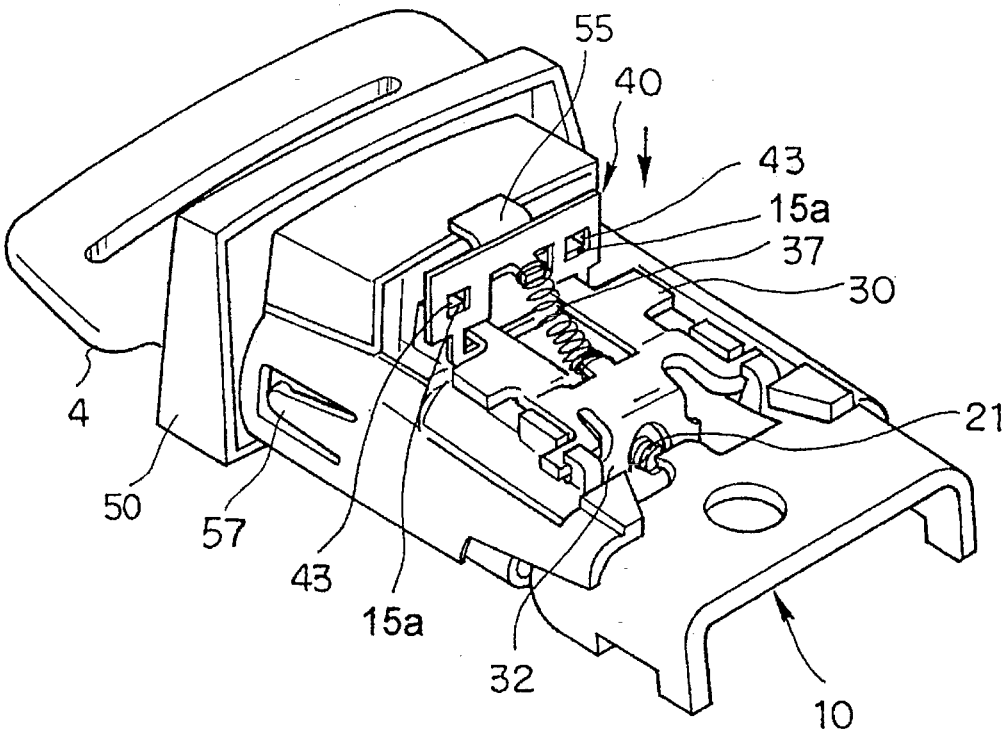
FIG. 6 is a perspective view of the buckle as shown in FIG. 2, which shows the positional relation in the components when the tongue is engaged.

FIG. 6 shows the state in which the tongue plate 2 engages the latch plate 30. In the tongue engaging state, the upper claws 15*a* of the locking pawls 15 of the base frame 10 engage the engaging holes 43 of the locking wing 40, respectively. At the same time, the latch plate 30 is positioned parallel to the base frame 10. The latch pawl 33 formed at the end of the latch plate 30 is inserted into the opening 3 of the tongue plate 2. Thereby, the latch pawl 33 engages the end of the tongue plate 2 to keep the latched state of the tongue plate 2.

As shown in FIGS. 5 and 6, by the engaging movement of the latch pawl 33 by the pivoting of the latch plate 30 and the downward sliding of the locking wing 40 in which the locking wing 40 rotates and stands against the biasing force of the locking spring 37 upon the pivoting of the latch plate 30, the upper claws 15*a* of the locking pawls 15 securely engage the engaging holes 43 of the locking wing 40.

Now, the description will be made as regard to the operation of the buckle about FIGS. 7 (*a*)–7 (*d*).

Figure 7:
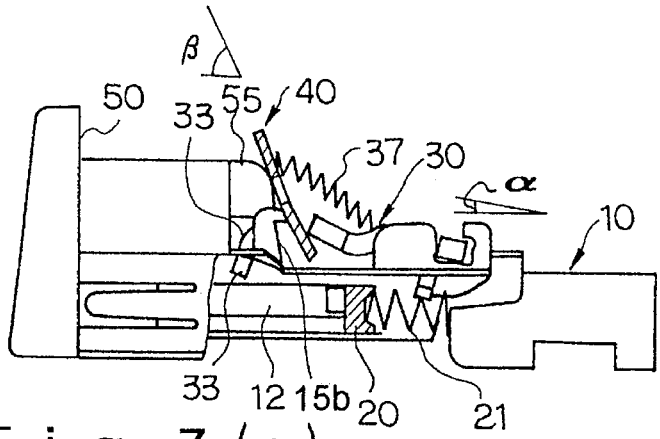
FIGS. 7(*a*)–7(*d*) are explanation views showing the operating state of insertion and release movements of the tongue.
Figure 7:
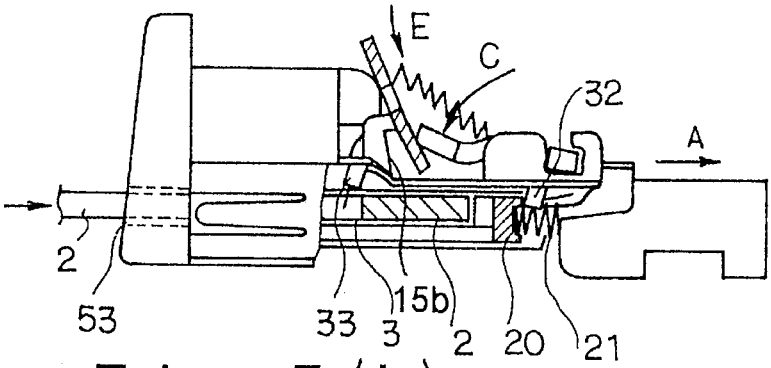
Figure 7:
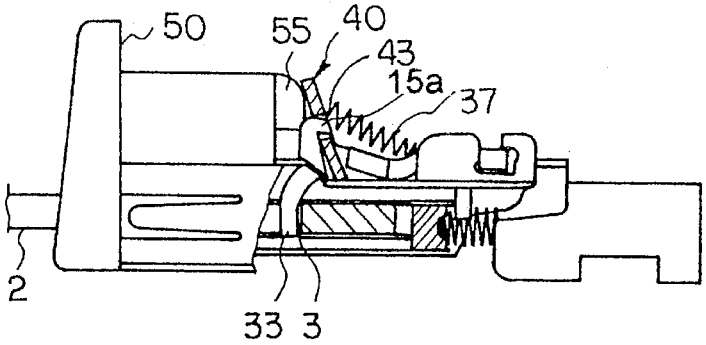
Figure 7:
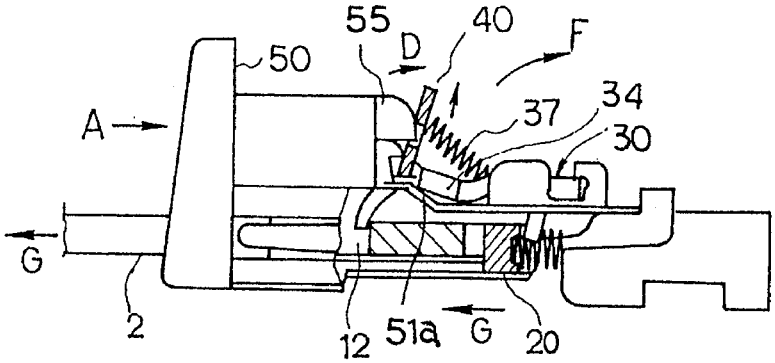

FIG. 7 (*a*) is an explanation view showing the initial state before the insertion of the tongue plate 2. As shown in this figure, the latch plate 30 is maintained in the state in which the latch plate 30 has pivoted by the angle α to the base frame 10 by the biasing force of the locking spring 37. The locking wing 40 is in contact with the contact portion 55 formed on the back of the press button 50 and the ends of the upper claws 15*a* of the locking pawls 15 of the base frame 10 and is then positioned to be maintained to tilt by the angle β to the base frame 10. As apparent from this figure, the latch pawl 33 of the latch plate 30 tilting by the angle α is positioned outside the tongue insertion path 12.

On the other hand, the ejector 20 in the initial state which is kept in the predetermined position by the ejector spring 21 is set slidable along the tongue insertion path 12.

The description will now be made as regard to the movements of the components when the tongue plate 2 is inserted into the buckle, about FIG. 7 (*b*) and FIG. 7 (*c*). The tongue plate 2 is inserted from the tongue insert opening 53, the tongue plate 2 passes through the tongue insertion path 12 of the base frame 10 and then the end of the tongue plate 2 meets the ejector 20. Further, the tongue plate pushes the ejector 20 to move it in the direction of the arrow A shown in this figure against the biasing force of the elector spring 21. As the ejector 20 is moved to a certain point, the back of the ejector 20 meets the operational arms 32 of the latch plate 30 which is located in the way of the ejector 20. As the tongue plate is further inserted, the ejector 20 pushes the operational arms 32 of the latch plate 30 rearward. By the pushing movement of the ejector 20, the latch plate 30 as a whole pivots in the direction of the arrow C about the wing-like shafts 31 located in the bearing pawls 16. Upon the pivoting of the latch plate 30, a portion of the latch plate 30 keeping in contact with the opening 42 of the locking wing 40 pushes down the locking wing 40 in the direction of the arrow E as the locking wing 40 slides. At the same time, the latch pawl 33 formed at the end of the latch plate 30 is inserted into the opening 3 of the tongue plate 2 to start being in the engaged state.

From the state shown in FIG. 7 (*b*), as the locking wing 40 is moved further downward, the engaging holes 43 of the locking wing 40 are engaged with the upper claws 15*a* of the locking pawls 15 of the base frame 10 as shown in FIG. 7 (*c*). At the same time, the latch pawl 33 of the latch plate 30 completely engages the opening 3 of the tongue plate 2. Thereby, the engagement of the tongue plate 2 is completed. In this state, the latch plate 30 is substantially parallel to the base frame 10.

The locking wing 40 is pushed against surfaces 15*b* of the locking pawls 15 due to the biasing force of the locking spring 37 in the compressed state. Accordingly, the engagement between the upper claws 15*a* of the locking pawls 15 and the engaging holes 43 of the locking wing 40 is securely maintained (see FIG. 7 (*c*)). Therefore, the tongue plate 2 is securely engaged to the buckle.

Furthermore, the description will be made as regard to the release of the tongue about FIG. 7 (*d*).

As the press button 50 is pressed in the direction of the arrow A, the contact portion 55 of the press button 50 rotate slightly the locking wing 40 in the direction of the arrow D, thereby releasing the engagement between the upper claws 15*a* of the locking pawls 15 and the engaging holes 43 of the locking wing 40. At the moment, the locking wing 40 is moved to be lifted upward by the biasing force of the locking spring 37. The latch plate 30 then pivots in the direction of the arrow F to release the engagement between the latch pawl 33 and the opening 3 of the tongue plate 2 so that the ejector 20 moves quickly in the direction of the arrow G by the biasing force of the ejector spring 21 in the compressed state. Thereby, the tongue plate 2 is ejected in the direction of the arrow G from the tongue insertion path 12. Therefore, the release of the tongue plate 2 can be securely performed.

Portions 51*a* of the side walls of the press button 50 are designed to meet the wings 34 of the latch plate 30 in a direction of pushing up the latch plate 30, thereby securing the reliability of the release of the tongue plate 2.

What is claimed is:

1. A buckle for engaging a tongue plate with an opening, comprising:

a base frame having locking pawls on an upper surface thereof and a tongue insertion path through which the tongue plate is inserted;

a latch plate pivotally supported on an upper surface of said base frame, and having a latch pawl formed at a front end portion thereof which is able to engage with the opening of said tongue plate inserted into said tongue insertion path, and an operational arm formed at a rear portion thereof which is applied with pivoting force by an end of said tongue plate when said tongue plate is inserted;

a locking wing having a locking spring for maintaining a locked state of said latch plate by biasing force of the locking spring set between said locking wing and said latch plate and by an engagement between said locking wing and said locking pawls of said base frame, said locking wing comprising a plate formed with two engaging holes and operating such that when said tongue plate is inserted, said locking wing keeps in contact with said latch plate to move downward corresponding to pivoting of said latch plate and maintains the locked state of said latch plate by engaging said engaging holes with ends of said locking pawls at a position where said engaging holes correspond to the ends of said locking pawls;

a press button with a contact portion movably arranged relative to the locking wing, said locking wing releasing the engagement between said locking wing and said locking pawls by the contact portion of the press button corresponding to a movement of said press button; and an ejector slidably supported in said tongue insertion path and having an ejector spring, said ejector being biased by the ejector spring and structured to, corresponding to the insertion of said tongue plate, come in contact with the end of said tongue plate, to slide, and to push said operational arm to pivot said latch plate to engage said latch pawl to said opening of said tongue plate, said ejector also being structured to eject said tongue plate outside said buckle by the biasing force of said ejector spring when the engagement between said latch pawl and said opening of said tongue plate is released.

2. A buckle as claimed in claim 1, wherein both sides of said tongue insertion path are defined by tongue guiding portions formed by bending said base frame in a U-like shape to face each other.

3. A buckle for engaging a tongue plate with an opening, comprising:

a base frame having a locking pawl on an upper surface thereof and a tongue insertion path through which the tongue plate is inserted;

a latch plate pivotally supported on an upper surface of the base frame, and having a latch pawl formed at a front end portion thereof which is able to engage with the opening of said tongue plate inserted into the tongue insertion path, and an operational arm formed at a rear portion thereof which is applied with pivoting force by an end of the tongue plate when the tongue plate is inserted;

a locking wing situated adjacent to the base frame and having an engaging hole therein and a locking spring interposed between said locking wing and said latch plate, said locking wing being maintained by the locking spring such that the engaging hole does not engage the locking pawl and, upon insertion of the tongue plate, being moved such that the engaging hole engages the locking pawl to thereby permit engagement between the latch pawl and the opening of the tongue plate;

a press button movably arranged relative to the locking wing, said locking wing being released from the locking pawl by movement of the press button; and an ejector slidably supported in said tongue insertion path and having an ejector spring, said ejector being biased by the ejector spring and contacting, upon insertion of the tongue plate, an end of the tongue plate to slide and pushing the operational arm for pivoting the latch plate to engage the latch pawl with the opening of the tongue plate, said ejector ejecting the tongue plate outside the buckle by a biasing force of the ejector spring when the engagement between the latch pawl and the opening of the tongue plate is released.

4. A buckle as claimed in claim 4, wherein said locking wing has a central opening through which said latch plate passes, and said latch plate has wings contacting the press button when the tongue plate is released from the buckle.

* * * * *